US006705136B2

(12) United States Patent
Porter

(10) Patent No.: US 6,705,136 B2
(45) Date of Patent: Mar. 16, 2004

(54) STORAGE COMPARTMENT SECURITY SYSTEM

(76) Inventor: Dave Porter, 1011 W. Wade Hampton Blvd., Greer, SC (US) 29650

( * ) Notice: Subject to any disclaimer, the term of this patent is extended or adjusted under 35 U.S.C. 154(b) by 0 days.

(21) Appl. No.: 10/023,289

(22) Filed: Dec. 14, 2001

(65) Prior Publication Data

US 2002/0178771 A1 Dec. 5, 2002

Related U.S. Application Data

(60) Provisional application No. 60/294,327, filed on May 30, 2001.

(51) Int. Cl.[7] ..... E05B 13/00; E06B 7/00

(52) U.S. Cl. ..... 70/210; 70/257; 70/278.7; 70/279.1; 70/283; 70/DIG. 65; 109/59 R; 109/67; 292/39; 292/254; 292/DIG. 26; 292/DIG. 32

(58) Field of Search ..... 70/DIG. 65, DIG. 63, 70/210, 278.7, 283, 279.1; 109/59 R, 59 T, 67; 292/254, DIG. 32, DIG. 21, 39, DIG. 18; 49/394, 395

(56) References Cited

U.S. PATENT DOCUMENTS

| | | | | | |
|---|---|---|---|---|---|
| 279,334 | A | * | 6/1883 | Clark | |
| 596,050 | A | * | 12/1897 | Byrnes | |
| 932,330 | A | * | 8/1909 | Rotchford | |
| 1,004,690 | A | * | 10/1911 | Russell | |
| 1,070,366 | A | * | 8/1913 | Voight | |
| 1,077,433 | A | * | 11/1913 | Schlis | |
| 1,368,141 | A | * | 2/1921 | Hagstrom | |
| 1,535,210 | A | * | 4/1925 | Dyer | |
| 3,647,243 | A | | 3/1972 | Nagy et al. | 280/433 |
| 3,735,714 | A | * | 5/1973 | Shoop | 70/417 X |
| 3,812,403 | A | | 5/1974 | Gartner | 317/134 |
| 3,933,382 | A | | 1/1976 | Counts et al. | 292/144 |
| 4,283,882 | A | * | 8/1981 | Hubbard et al. | 49/141 |
| 4,384,465 | A | * | 5/1983 | Muus | 70/129 |
| 4,679,415 | A | * | 7/1987 | Spratt | 70/118 |
| 4,688,492 | A | * | 8/1987 | Peghetti | 109/56 |
| 4,866,963 | A | | 9/1989 | Leininger et al. | 292/144 X |
| 5,010,754 | A | | 4/1991 | De Angelo et al. | 70/389 |
| 5,094,483 | A | * | 3/1992 | James | 292/39 |
| 5,351,512 | A | | 10/1994 | Pearlman | 70/257 |
| 5,404,736 | A | | 4/1995 | Lugo | 70/168 |
| 5,532,521 | A | | 7/1996 | Leininger | 307/10.2 |
| 5,603,328 | A | | 2/1997 | Zucker et al. | 128/664 |
| 5,609,051 | A | * | 3/1997 | Donaldson | 70/303 A X |
| 5,760,703 | A | | 6/1998 | Becker | 70/277 X |
| 5,778,708 | A | * | 7/1998 | Crosby et al. | 70/118 |
| 5,791,179 | A | * | 8/1998 | Brask | 70/110 X |
| 5,806,355 | A | | 9/1998 | Lanigan et al. | 70/257 |
| 5,833,111 | A | | 11/1998 | Martineau | 220/6 |
| 5,970,890 | A | * | 10/1999 | Harry et al. | 109/73 |
| 6,050,116 | A | | 4/2000 | Cole | 70/256 |
| 6,298,699 | B1 | | 10/2001 | Gartner et al. | 70/278.1 |

FOREIGN PATENT DOCUMENTS

| | | | | |
|---|---|---|---|---|
| DE | 329698 | * | 11/1920 | 70/DIG. 65 |
| JP | 404073382 A | * | 3/1992 | 70/DIG. 65 |

* cited by examiner

*Primary Examiner*—Lloyd A. Gall
(74) *Attorney, Agent, or Firm*—McNair Law Firm, P.A.

(57) ABSTRACT

A security system for a storage compartment including a latch assembly disposed on an interior side of a door for latching the door in a closed position with the storage compartment. A plurality of reciprocating latch elements are included in the latch assembly for latching the door in a closed position with the storage compartment. A latch actuator included in the latch assembly moves the latch elements to latch the door. A master lock assembly controls operation of the latch actuator by having a first locking part of the master lock assembly interlocking with a second locking part carried by the latch actuator. A tamper-resistant master lock control controls operation of the master lock assembly from outside the storage compartment whereby access to the compartment interior is prevented when the latch assembly is latched and the master lock assembly is in the locked position.

6 Claims, 11 Drawing Sheets

STORAGE COMPARTMENT SECURITY SYSTEM

Applicant claims priority of Provisional Application Ser. No. 60/294,327, filed May 30, 2001.

FIELD OF THE INTENTION

This invention is directed to a security system for storage compartments, and more particularly, to a latch assembly and master lock assembly mounted in the compartment interior for securing access doors of the compartment wherein the interior latch and master lock assembly may be operated by a tamper-resistant control on the compartment exterior while the latch and lock assemblies have no exterior components capable of destruction from outside the compartment.

BACKGROUND OF THE INVENTION

Every year, millions of dollars in equipment are stolen from construction sites. Often, a single piece of equipment costs thousands of dollars. In addition to the loss of equipment, the time taken to replace even the most inexpensive equipment can be great. Construction delays can result in thousands, if not millions of dollars in construction contract damages, lost revenue, and other costs.

At the construction site, storage containers are usually provided to store this equipment and used to deter theft thereby saving significant money and time. However, many of these containers have no, or only simple locking devices that have little effect against theft. Additionally, these devices can be defeated externally with little effort, are overly burdensome, unnecessarily complicated and do little to actually make the containers more secure.

For example, an external padlock can be easily defeated with bolt cutters. To compound the problem, a typical situation of individual insider theft occurs by one employed at a construction site who, for example, may be specifically skilled in metalworking. Such an individual has little trouble cutting through external locking systems.

Previous attempts to address the problem of theft from storage compartments using an internally mounted security system have only produced weak solutions that are easily defeated and provide a false sense of security. For example, U.S. Pat. Nos. 3,933,382 and 5,760,703 disclose security locks for the door of a cargo truck. The locks operate using a single electrically controlled bolt which locks with a wheel track of the door assembly, or in a bracket carried by the door. There is no other lock or latch assembly utilized to prevent the door from being unlocked. Overcoming a single lock is relatively straight forward and may easily be done to open the door.

U.S. Pat. No. 4,866,963 discloses a security system for locking doors on a cargo truck. The system employs a latch assembly carried on the exterior of the doors, but the latch assembly has no lock. Again, only a single bolt, as discussed above, on the interior side of the door is utilized to lock and secure the door. Because there is no cooperation between the exterior latch assembly and the internally mounted security bolt, only a single bolt secures one of the two large storage compartment doors, which can be easily defeated.

U.S. Pat. No. 6,298,699 shows a typical electronic combination lock for a residential or commercial entrance door having a dial-shaped handle with a keypad incorporated therein. When the correct combination is selected a deadbolt may be unlocked. This type of locking mechanism is not meant for use in a security system needed to control access to a large cargo container.

Accordingly, an object of the present invention is to provide a security system mounted on the interior of a storage compartment which does not have externally mounted components that may be tampered with to attempt to gain access to the compartment interior.

Another object of the present invention is to provide a security system for a storage container which is cost efficient, easy to use, and requires multiple components to be defeated in order to open the lock and gain access to the interior of the storage compartment.

Another object of the present invention is to provide a security system for a storage compartment wherein the main latch assembly for securing the door includes multiple internal securing points operated from a single internally mounted main latch assembly that is controlled by a tamper-resistant control for locking and unlocking the storage compartment doors.

SUMMARY OF THE INVENTION

The above objectives are accomplished according to the present invention by providing a security system for preventing unauthorized access to a storage compartment wherein the compartment has an entryway for allowing access to a compartment interior, and a door closing said entryway and preventing access to the compartment interior. The security system includes a latch assembly carried by the door for latching the door in a closed position with the storage compartment. In accordance with the invention, the latch assembly is disposed entirely on an interior side of the door within the compartment interior. The latch assembly has an engaged position to latch the door in the closed position in which the entryway is closed, and a disengaged position wherein the door may be opened to provide access to the compartment interior. At least one reciprocating latch element is included in the latch assembly for latching the door with the storage compartment when the latch assembly is in the engaged position. A receiving member is carried by the storage compartment for receiving the latch element so that the latch element and receiving member latch the door in the closed position. A latch actuator is included in the latch assembly for moving the latch assembly between the engaged and disengaged positions. An operator connects with the latch actuator that is manually operable from outside the compartment for operating the latch actuator on the interior side through the door.

Advantageously, a master lock assembly is operatively connected to the latch assembly on the interior side for controlling whether the latch actuator may be operated. The master lock assembly includes a first locking part interlocking with a second locking part carried by the latch assembly. The master lock assembly has a locked position wherein the first locking part is locked together with the second locking part to prevent the latch assembly from being moved to the disengaged position, and an unlocked position wherein the first and second locking parts are unlocked so that the latch assembly may be moved to the disengaged position. The master lock assembly is carried within the compartment interior to prevent destruction of the master lock assembly from outside the compartment. A master lock actuator is provided for manually operating the master lock assembly from outside the storage compartment.

A tamper-resistant master lock control is provided for controlling the master lock assembly between the locked and unlocked positions from outside the compartment, whereby access to the compartment interior is prevented when the latch assembly is in the engaged position and the master lock assembly is in the locked position.

In another embodiment, a main latch assembly is entirely on an interior side of a first door within the compartment interior, and a secondary latch assembly is carried by a second door for latching the second door in a closed position with the storage compartment. The secondary latch assembly is disposed entirely on an interior side of second door within the compartment interior. A plurality of main latch elements is included in the main latch assembly for latching the first door with top and bottom portions of the storage compartment. A horizontal reciprocating latch element is included in the main latch assembly for actuating the secondary latch assembly and latching the second door in the closed position together with the first door and the storage compartment. The secondary latch assembly includes a plurality of secondary reciprocating latch elements for latching the second door with top and bottom portions of the storage compartment. A main latch actuator is included in the main latch assembly connected to the plurality of main latch elements for moving the main latch elements to latch the first door with the storage compartment and actuating the secondary latch assembly. A secondary latch actuator is included in the secondary latch assembly that is operated by the horizontal reciprocating latch element. The secondary latch actuator being connected to the plurality of secondary reciprocating latch elements for moving the secondary latch elements to latch the second door with the storage compartment. An operator is provided that is manually operable from outside the compartment for operating the latch actuator on the interior side through the door, whereby access to the compartment interior is prevented when the main latch assembly is operated to latch together with the second door and the storage compartment.

In a particularly advantageous embodiment, the main latch actuator is a rack and pinion mechanism carried by the first door having a pinion meshing with a plurality of toothed racks. The operator engages and rotates the pinion which converts the rotary movement of the pinion to the linear movement of the racks in order to operate the main latch assembly. The racks being connected to the main latch elements so that when the pinion is rotated by the operator the main latch elements latch the first door to the storage compartment and actuate the secondary latch assembly. The secondary latch actuator includes an abutment bar which is engaged and operated by the horizontal reciprocating latch element. The abutment bar is pivotally connected to an upper pivot arm and a lower pivot arm. The upper and lower pivot arms are each pivotally connected to one of the secondary reciprocating latch elements so that when the abutment bar is operated, the pivot arms extend the secondary reciprocating latch elements to latch the second door. A guide member is carried by the abutment bar which is received by a guide bracket carried on the interior side of the second door to maintain the abutment bar in fixed vertical alignment with the horizontal latch element.

In an alternative embodiment, the latch actuator includes a rotary hub connected to two vertical reciprocating rods which engage with the top and bottom sides of the storage compartment when the hub is rotated to the engaged and locked position by the operator. The first locking part comprises a deadbolt that is received in a slot formed in the rotary hub which comprises the second locking part in order to prevent the hub from rotating when in the locked position. The deadbolt is raised out of the slot by the master lock actuator which includes an external storage compartment handle on the outside of the compartment connected to a lifting bar which moves the deadbolt to the unlocked position. When the handle is rotated, the bar lifts the deadbolt and allows the hub to be rotated by a second handle on the outside of the storage compartment door.

To prevent the deadbolt from being moved and the latch assembly disengaged by anyone who wanders by, a deadbolt stop is provided which is displaced vertically over the deadbolt. The deadbolt stop prevents the deadbolt from being raised until the deadbolt stop is rotated horizontally. In one embodiment, a solenoid is attached to the stop by a solenoid arm and connector linkage. When power is supplied to the solenoid, the solenoid arm is retracted and the deadbolt stop moved to allow the deadbolt to be lifted to the unlocked position. Power is supplied to the solenoid through a remote control device or key switch that completes an electrical circuit and gives power to the solenoid.

When the power is removed from the solenoid, the deadbolt returns to the locked position. In an alternative embodiment, the solenoid is replaced with an external combination locking mechanism. The locking mechanism is directly connected to the deadbolt stop, and, when the proper combination is entered, the locking mechanism may be rotated and the deadbolt stop moved to allow the deadbolt to be raised and the hub rotated.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
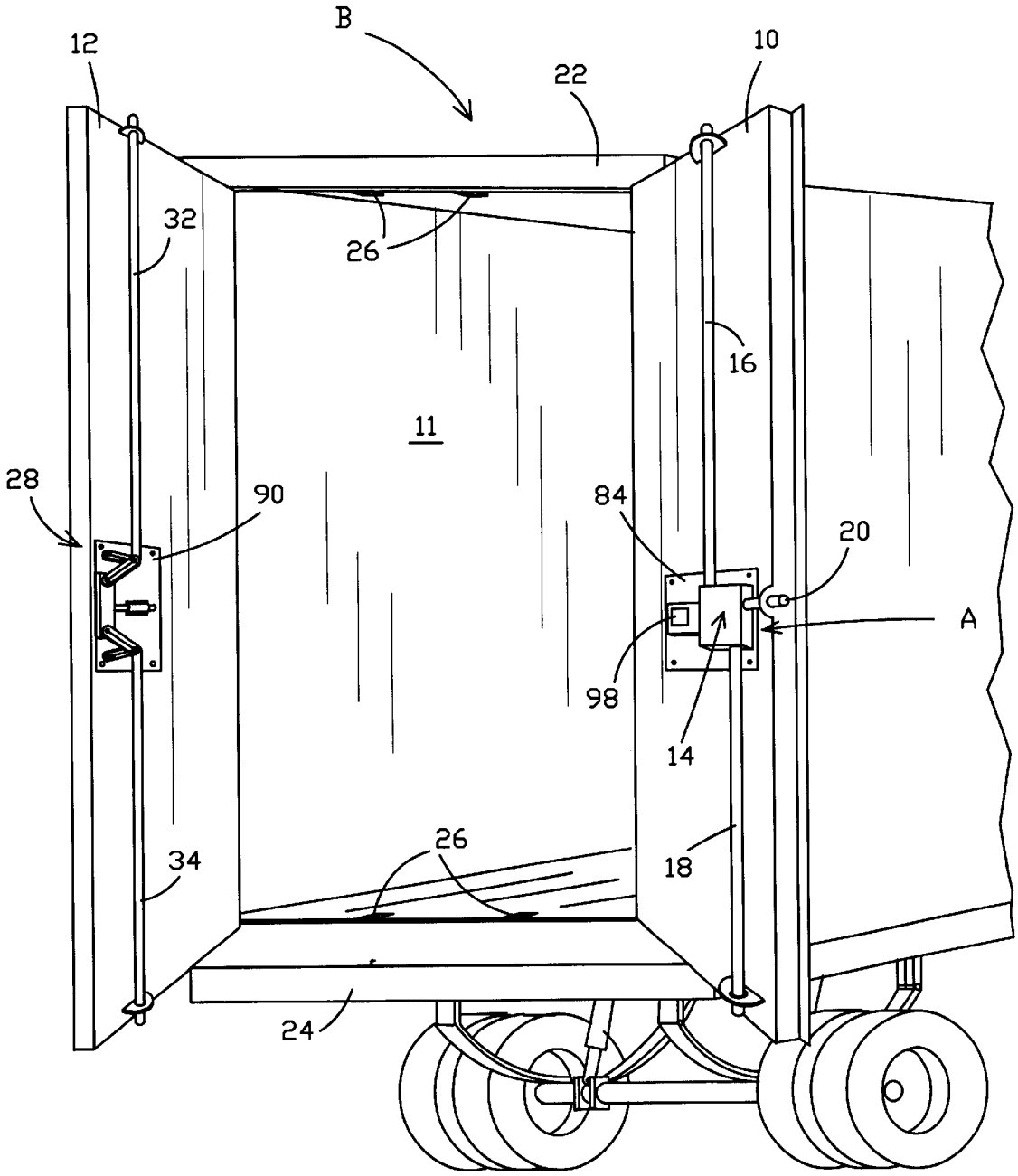
FIG. 1 shows a perspective view of the security system mounted to a storage container according to the invention.

Referring now to the drawings, the invention will be described in more detail. As best shown in FIG. 1, the present invention is an internally mounted security system A or latch assembly used to secure an entryway for a storage compartment B. Typically the storage compartment is a storage container of the type often found at a construction site or used by semi-tractor trailers. Generally, these storage compartments have two large doors 10 and 12 which are located at one end of the compartment to gain access to the compartment interior 11. The components of the security system used to secure the doors are advantageously mounted on the interior sides of the doors within the storage compartment interior in order to eliminate tampering with the locking components and prevent unauthorized access to the contents of the storage compartment.

Referring to FIG. 1, the security system includes a primary latch assembly 14 carried on the interior side of first door 10 for latching the door in a closed position to prevent access to the storage compartment interior. Because the latch assembly is disposed entirely within the compartment interior when door 10 is locked in a closed position, there is nothing on the outside of the storage compartment that may be tampered with to attempt to gain access the compartment interior. Primary latch assembly 14 has an engaged position for latching movable door 10 in a closed position in which the entryway for the compartment interior is closed off, and a disengaged position wherein door 10 may be opened to provide access to the compartment interior.

Figure 8:
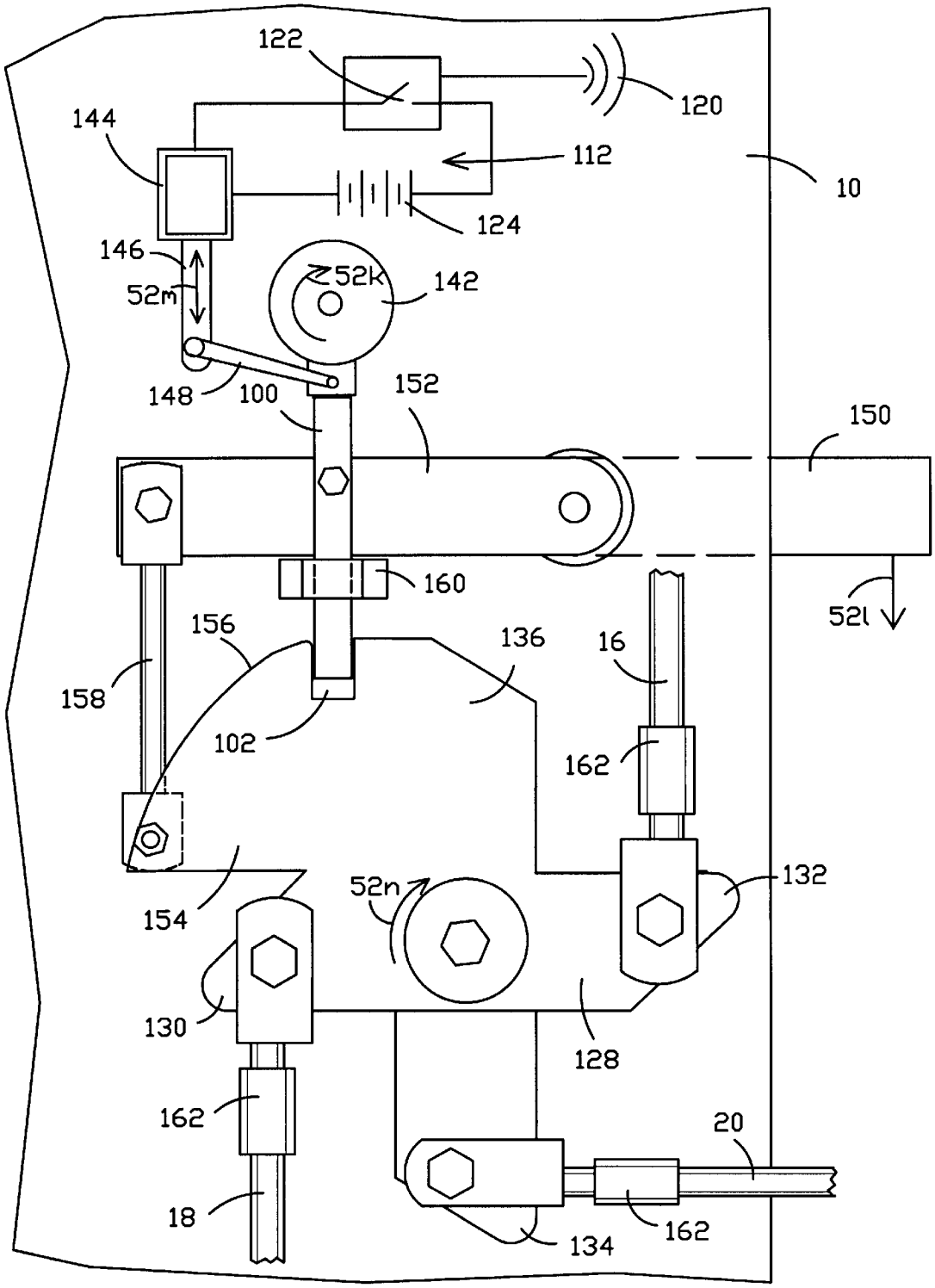
FIG. 8 shows an alternative embodiment of the security system according to the invention; and, FIG. 9 shows an alternative embodiment of the security system with a removable operator incorporating an electronic keypad for operating the master lock assembly.

In order to latch door 10 to the storage compartment, primary latch assembly 14 includes reciprocating latch elements 16, 18, and 20. Latch elements 16 and 18 are vertical reciprocating latch elements aligned to engage top side 22 and bottom side 24 of storage compartment B when latch assembly 14 is in the engaged position. Top and bottom sides 22 and 24 include receiving members 26 for receiving latch elements 16 and 18 to latch door 10 in the closed position. In the preferred embodiment, the latch elements are formed from hardened metal rods resistant to bending or breaking from tampering. As shown in FIG. 8, adjustable connectors 162 are included in the rods to increase or decrease the effective length of the latch elements to vary the portion of the latch element that is received by the receiving members. The receiving members can be formed from holes, with or without reinforcement, cut into top and bottom sides 22 and 24, having a sufficient diameter to receive latch elements 16 and 18. In the preferred embodiment, receiving members 26 are made from hardened metal sleeves flush mounted into top and bottom sides 22 and 24 of the interior surface of the storage compartment, as best shown in FIG. 1. Latch element 20 is a horizontal reciprocating latch element aligned to engage the side of the storage compartment where only one door is provided to access the storage compartment. An additional receiving member can be mounted on the side of the storage compartment in order to receive latch element 20 and secure door 10.

As shown in FIG. 1, when two doors are provided which create an entryway into the compartment interior, horizontal reciprocating latch element 20 can be used to secure second door 12 in a closed and locked position. Second door 12 carries a secondary latch assembly 28 on the interior side of door 12 for latching the door in a closed position to prevent access to the storage compartment interior. When doors 10 and 12 are moved to the closed position and primary latch assembly 14 is moved to the engaged position, latch element 20 is moved horizontally to engage a securing bracket 30 and operate secondary latch assembly 28 as described herein below in more detail. In the preferred embodiment, secondary latch assembly 28 includes secondary reciprocating latch elements 32 and 34 vertically aligned to engage receiving members 26 and latch second door 12 in the closed and locked position together with first door 10 and storage compartment B.

Figures 2, 2A:
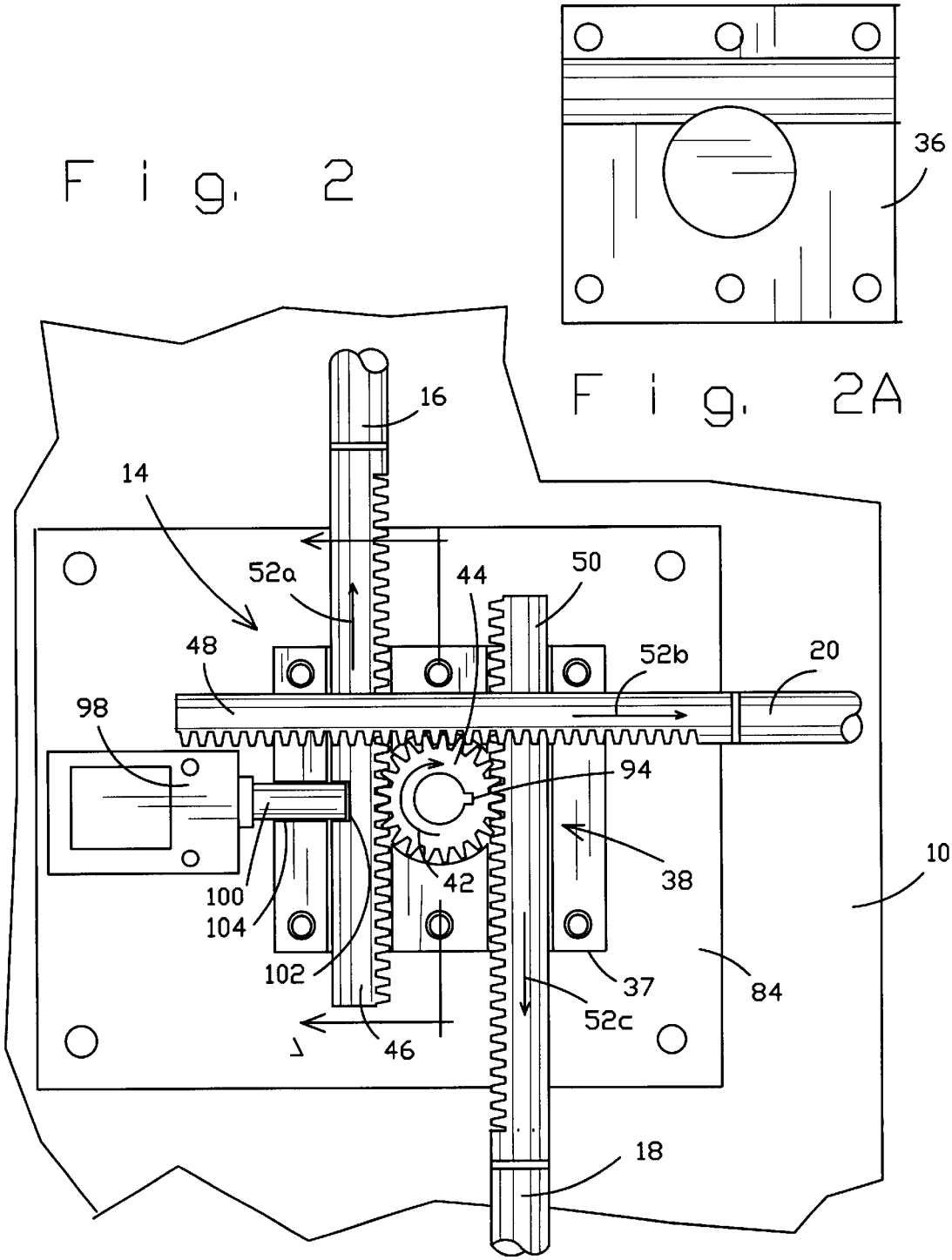
FIG. 2 is a front elevation view of the security system mounted to the interior side of the storage compartment door.
FIG. 2A shows an upper latch assembly housing.

Referring now to FIG. 2, latch assembly 14 is shown with an upper housing 36 (FIG. 2*a*) removed from lower housing 37 to expose the internal latch assembly components. Bolts 39 (FIG. 4) are used to secure upper housing 36 to lower housing 37. Latch assembly 14 includes a latch actuator, designated generally as 38, connected to latch elements 16, 18, and 20. Latch actuator 38 is operated by an operator 40 (FIG. 4) to move the latch assembly between engaged and disengaged positions, as described further below. In the preferred embodiment, latch actuator 38 is formed using a rack and pinion mechanism where pinion 44 receives operator 40 and is rotated in direction 42. Toothed pinion 44 meshes with toothed racks 46, 48, and 50 to complete the conversion of rotary movement of the pinion to linear movement of the racks and latch elements to position the latch assembly in the engaged or disengaged position. As pinion 44 is rotated in direction 42 to move primary latch assembly 14 to the engaged position, racks 46, 48 and 50 are extended in direction 52*a*, 52*b* and 52*c* simultaneously to force latch elements 16 and 18 into receiving members 26 carried in the top and bottom sides 22 and 24 of storage compartment B. In the preferred embodiment, latch element 20 is forced in direction 52*b* to engage securing bracket 30 and operate secondary latch assembly 28 to secure second door 12 in the closed and locked position.

Figure 3:
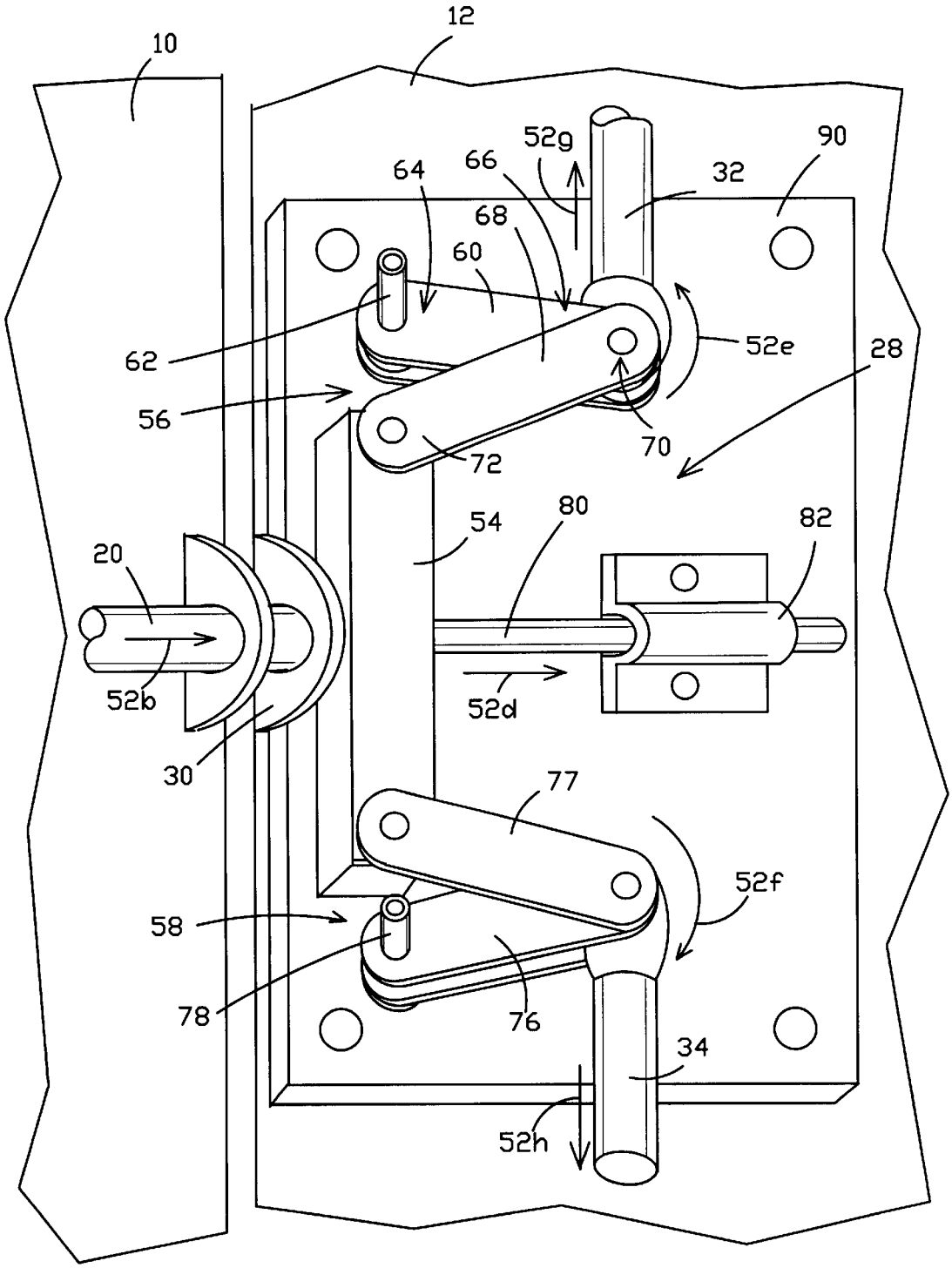
FIG. 3 shows a secondary latch assembly mounted on a second storage compartment door.

Referring to FIG. 3, secondary latch assembly 28 is carried on the interior compartment side of door 12 and includes abutment bar 54 which is engaged by horizontal reciprocating latch element 20. Abutment bar 54 is pivotally attached to an upper pivot arm, designated generally as 56, and a lower pivot arm, designated generally as 58. Pivot arm 56 includes a first arm segment 60 pivotally connected to a mounting bolt 62 at a first end 64, and a second end 66 pivotally connected to latch element 32. A second arm segment 68 has a first end 70 pivotally connected to latch element 32 and a second end 72 connected to abutment bar 54. Lower pivot arm 58 is of the same configuration, only inverted so that first arm segment 76 is pivotally connected to mounting bolt 78 and latch element 34 with second arm segment 77 connecting latch element 34 to abutment bar 54. As latch element 20 is moved in direction 52*b*, abutment bar 54 is engaged and moved in direction 52*d*, which forces upper pivot arm 56 to extend in direction 52*e* and lower pivot arm 58 to extend in direction 52*f*. As the pivot arms extend, latch element 32 is moved in direction 52*g* to engage receiving member 26 on top side 22 of storage compartment B, while latch element 34 is moved in direction 52*h* to engage receiving member 26 on bottom side 24 of storage compartment B. Because abutment bar 54 is pivotally connected on both ends, a guide member 80 is carried by abutment bar 54 to keep the plate in a fixed vertical position. Guide member 80 is received by guide bracket 82 which maintains abutment bar 54 in proper vertical alignment with horizontal latch element 20.

Figure 4:
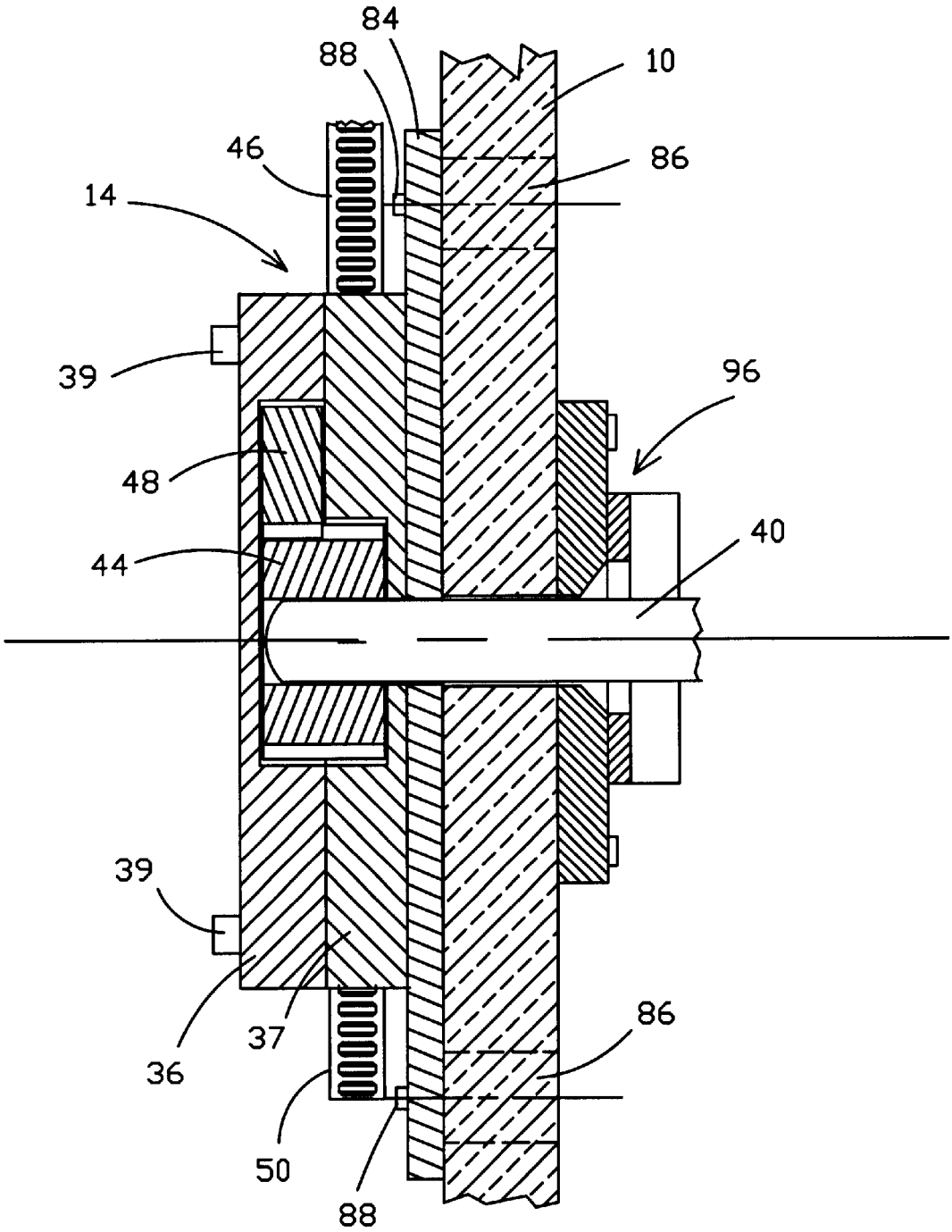
FIG. 4 shows a cross-section view of the latch assembly carried by a mounting plate affixed to the interior side of the storage compartment door.

Referring to FIG. 4, a cross section of latch assembly 14 is shown carried on the interior side of door 10 by a mounting plate 84. Because many doors on storage containers do not have flat surfaces where the latch assembly can be mounted, a mounting plate 84 can be anchored to the door to provide a flat surface for the latch assembly to be carried on the door. As well, the mounting plate provides a solid reinforcing plate that would have to first be defeated before the latch assembly components could be tampered with. In the preferred embodiment, door anchors 86 are inserted into door 10 which provide a reinforced structure to attach mounting plate 84 to the door. Bolts 88 are inserted through mounting plate 84 and into door anchor 86. As the bolts are tightened into door anchors 86, mounting plate 84 is secured against door 10 and provides a solid reinforcing structure to the door, which increases the tamper-resistance of the latch assembly and storage compartment door. Referring to FIGS. 1 and 3, a mounting plate 90 is also used to carry secondary latch assembly 28 on the interior side of door 12. Plate 90 is also mounted to door 12 as described above using door anchors 86.

Figure 5:
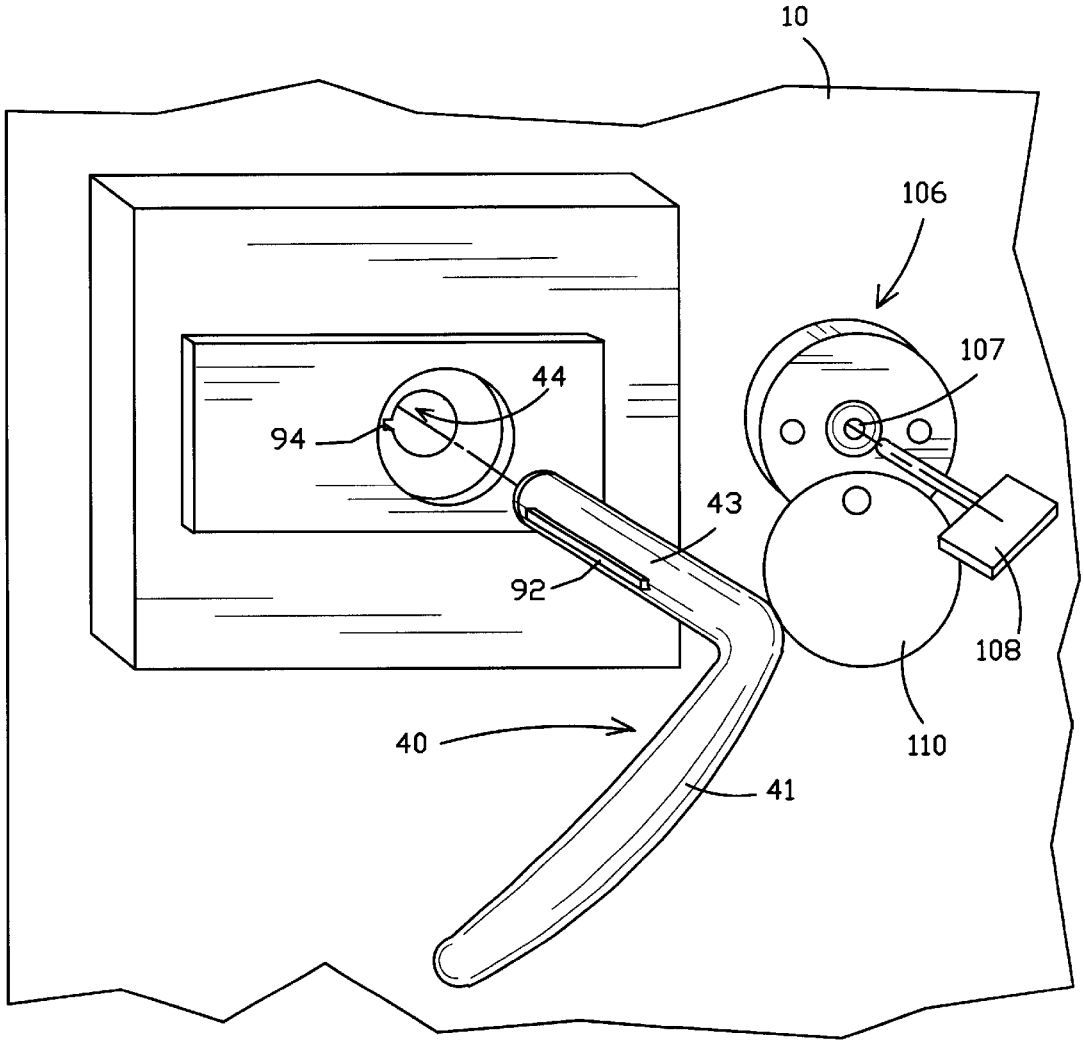
FIG. 5 shows an operator for moving the latch assembly and a master lock actuator according to the invention.
Figure 9:
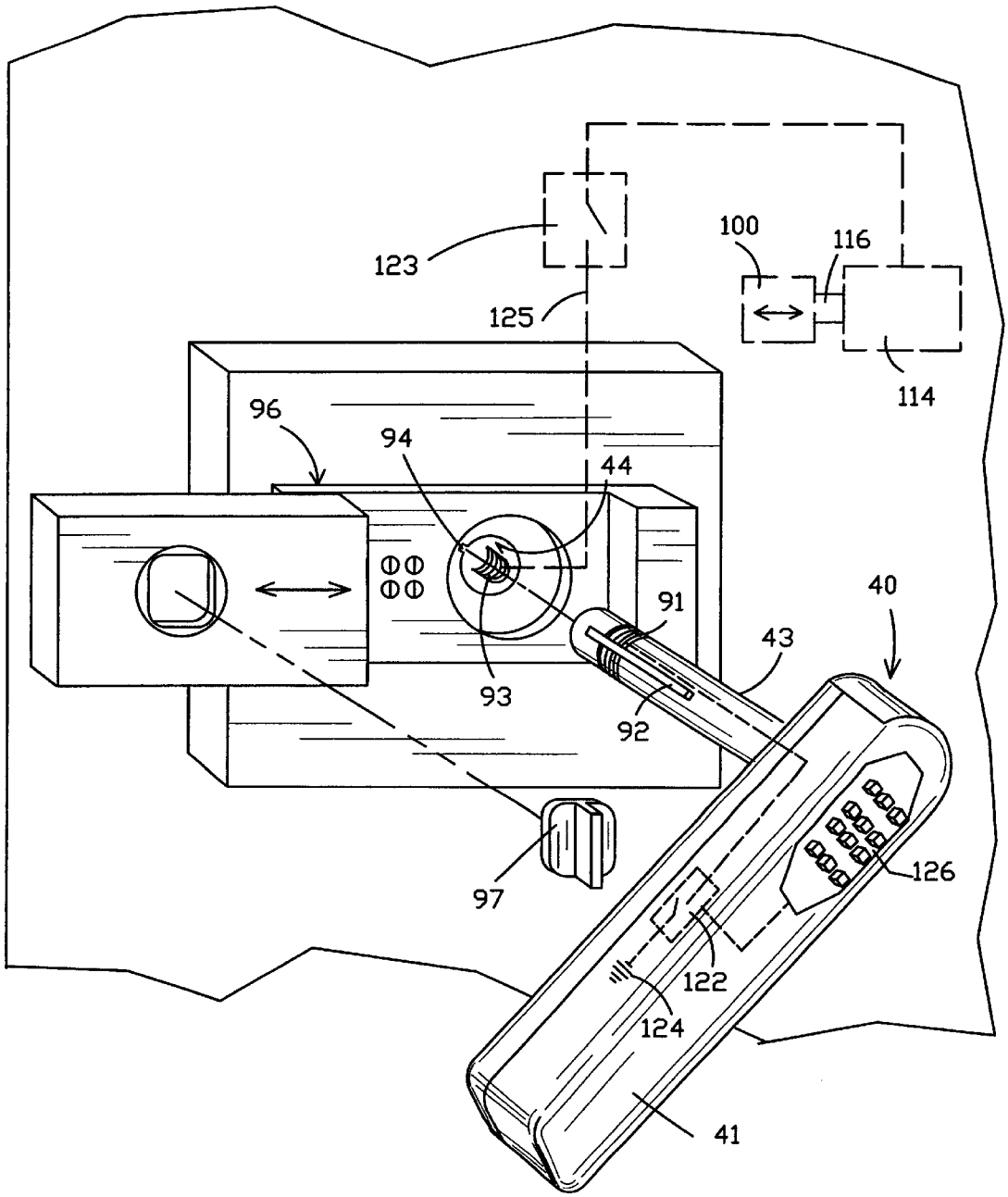

Referring to FIG. 5, in the preferred embodiment, operator, designated generally as 40, is shown having a handle 41 attached to a shaft 43 which can be manually operated to engage and disengage latch assembly 14. Handle 41 is also removable in order to eliminate any security system components on the exterior of door 10. To engage with pinion 44 (FIG. 4), handle shaft 43 is provided with a key 92 that is received in keyway 94 of pinion 44. This allows handle 41 to rotate pinion 44 and operate latch assembly 14. Referring to FIG. 4, because operator 40 must be inserted through door 10 to rotate pinion 44, when operator 40 is removed, a hole is created which can be used to tamper with latch assembly 14. By simply providing a magnetic key locking cover 96 with a magnetic key 97(as shown in FIG. 9) mounted to the exterior side of door 10, the hole can be covered and the latch assembly can not be tampered with.

As can best be seen in FIG. 2, a master lock assembly 98 is operatively connected to latch assembly 14 for controlling whether latch actuator 38, and ultimately latch assembly 14, can be operated between engaged and disengaged positions. Master lock 98 is carried by mounting plate 84 on the interior compartment side of door 10. Master lock 98 includes a first locking part 100 that interlocks with a second locking part 102 carried by latch actuator 38. Master lock 98 has a locked position wherein first locking part 100 is locked together with second locking part 102 to prevent latch actuator 38 from moving latch assembly 14 to the disengaged position. Master lock 98 also has an unlocked position wherein first locking part 100 and second locking part 102 are unlocked to allow latch actuator 38 to move latch elements 16, 18, and 20 to the disengaged position which allows doors 10 and 12 to open. In the preferred embodiment, first locking part 100 is a hardened metal deadbolt which can be inserted through opening 104 in lower housing 37 of latch assembly 14. The deadbolt can be replaced by any member which prevents the latch assembly from moving between engaged and disengaged positions, such as a pin that would be inserted into one of the latch elements. Preferably, the deadbolt interlocks with second locking part 102. As illustrated in FIG. 2, second locking part 102 is a notch formed in rack 46 which receives first locking part 100. The notch must be of a sufficient size and depth to receive first locking part 100 and prevent rack 46 from moving. Second locking part 102 may comprise a number of various members, such as a bracket, that can be carried by the latch actuator or other components of the latch assembly that can interlock with first locking part 100 and prevent the latch assembly from operating. In the preferred embodiment, master lock assembly 98 is a mechanical lock capable of retracting first locking part 100 from second locking part 102. Mechanical locks are well-known in the art, and only a description necessary to the understanding of the present invention is disclosed herein. A suitable mechanical lock is disclosed in U.S. Pat. No. 4,142,388.

Figure 5A:
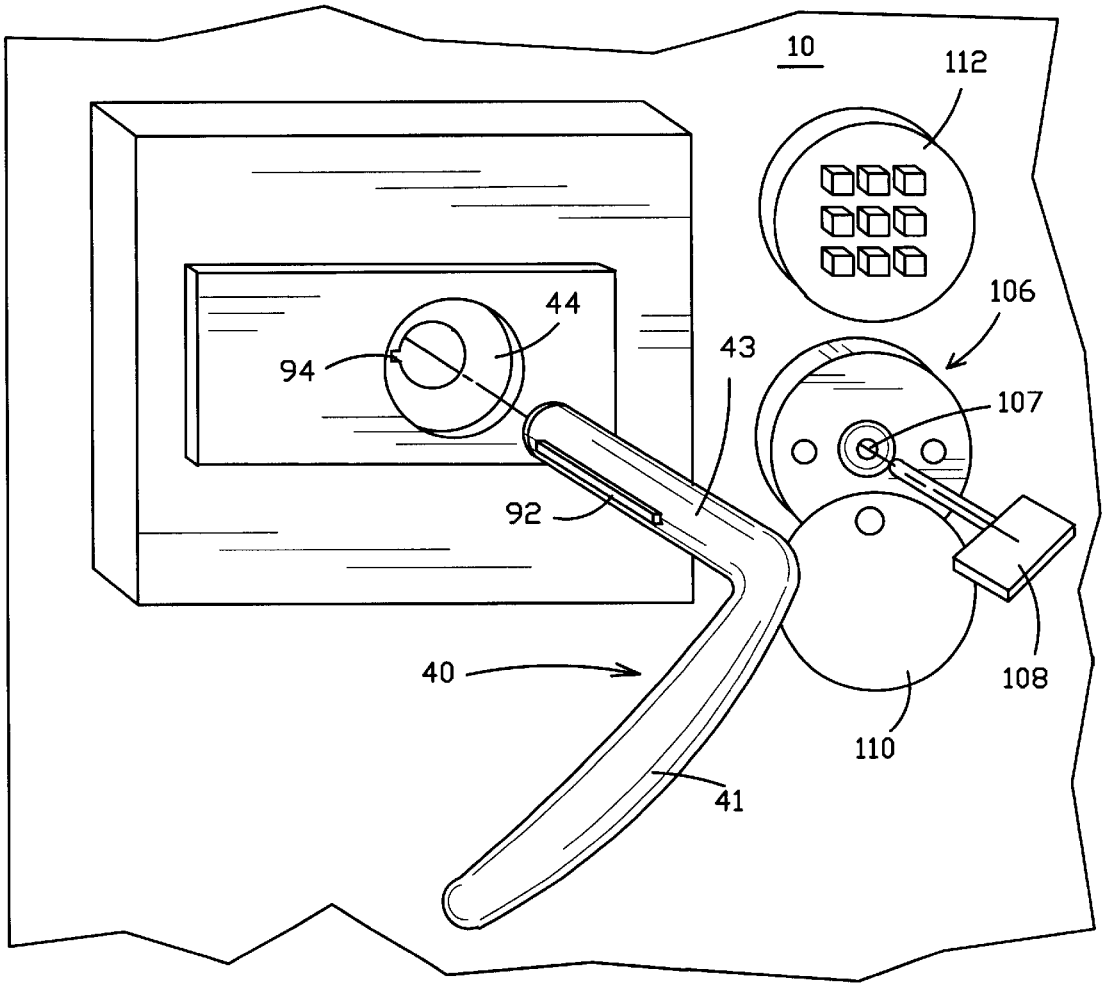
FIG. 5A shows the incorporation of a keypad tamper-resistant control for the master lock assembly according to the invention.

Referring to FIG. 5, master lock assembly 98 (FIG. 2) is operatively associated with a master lock actuator 108 operable from outside the storage compartment through door 10 for moving first locking part 100 to the unlocked position. When latch assembly 14 is in the engaged position with door 10 closed and master lock assembly positioned to the locked position, access to the storage compartment interior is prevented. The master lock actuator must be operated in order to unlock the master lock assembly and allow latch assembly 14 to be moved to the disengaged position so that the door may be opened. In the preferred embodiment, master lock actuator 108 comprises a key which is inserted through a keyhole 107 in door 10 and is received by master lock assembly 98. Turning master lock actuator 108 unlocks master lock assembly 98 by retracting first locking part 100, as disclosed in U.S. Pat. No. 4,412,388. A keyhole cover, designated generally as 106, is provided to prevent tampering with the keyhole that could lead to tampering with master lock assembly 98. As shown in FIG. 5, keyhole cover 106 includes a rotating lid 110 that is used to prevent any tampering with the keyhole itself or the internally mounted security system components. Lid 110 may be locked in a closed position covering keyhole 107 by any number of well known locking means. In an alternative embodiment shown in FIG. 5*a*, a tamper-resistant master lock control 112 is provided for controlling operation of master lock assembly 98 between locked and unlocked positions from outside said compartment. The tamper-resistant master lock control has an activated condition wherein the master lock actuator may be operated to unlock the master lock assembly. In the preferred embodiment, tamper-resistant master lock control 112 comprises a combination keypad lock 112 which sets the tamper-resistant master lock control in the activated condition when the correct combination is entered on the combination keypad. Thus, entering the correct code on combination keypad 112 allows master lock assembly 98 to be operated by master lock actuator 108 so that first locking part 100 is retracted from second locking part 102 to allow latch assembly 14 to be moved to the disengaged position.

Figure 2B:
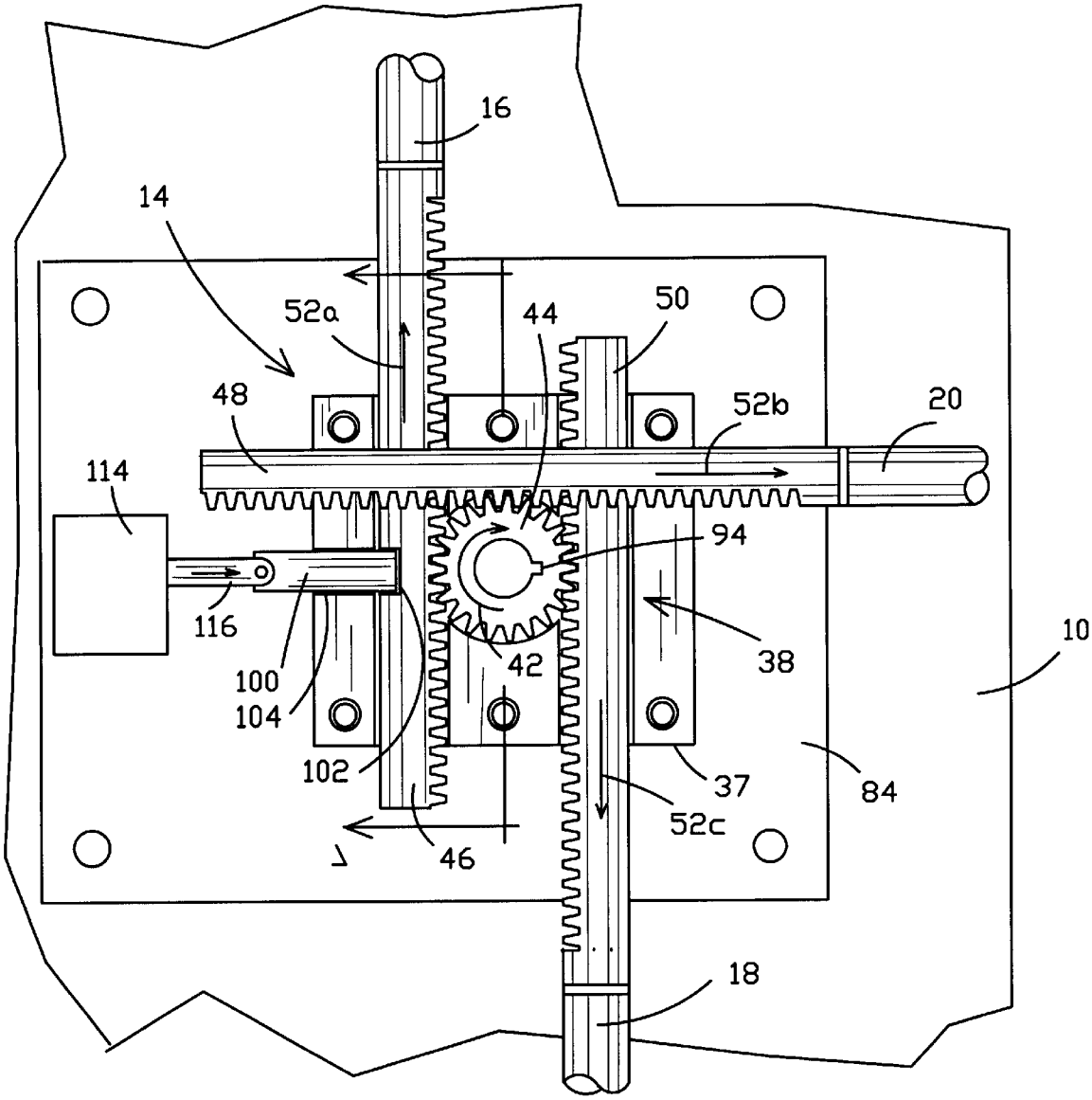
FIG. 2B shows an alternative embodiment of the security system according to the invention.
Figure 7:
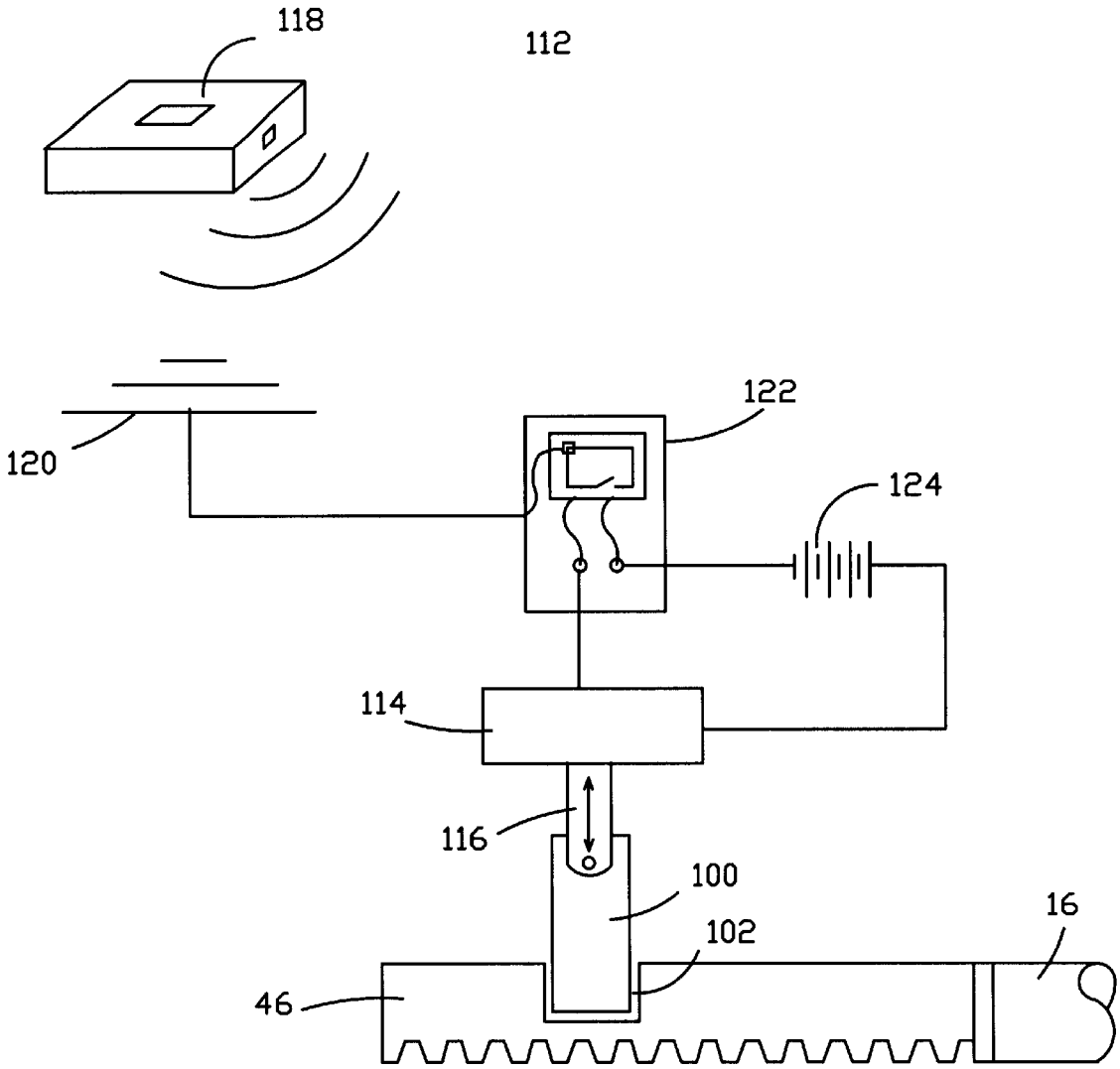
FIG. 7 a schematic representation of a wireless locking device according to the invention.

Referring to FIG. 2B, an alternative embodiment is provided wherein master lock assembly 98 includes a solenoid 114 mounted on the interior side of door 10. Solenoid 114 includes a solenoid arm 116 connected to first locking part 100. Solenoid arm 116 is extended and retracted by the solenoid to moved first locking part 100 between locked and unlocked positions with second locking part 102, respectively. Tamper-resistant master lock control 112 is operatively associated with solenoid 114 and has an activated condition wherein the solenoid arm is retracted to move first locking part 100 to the unlocked position, allowing the latch assembly to be disengaged and door to be opened. In this embodiment, tamper-resistant master lock control 112 is an electronic remote control 118 operated from outside the storage compartment. Remote control 118 sets the activated condition of tamper-resistant master lock control 112 for activating solenoid 114 so that solenoid arm 116 moves first locking part 100 to the retracted unlocked position. Referring to FIG. 7, remote control 118 transmits a signal to an antenna 120 which sends that signal to a solenoid control 122. Solenoid control 122 may be a simple switch which completes a circuit or a microprocessor requiring a particular signal or code in order to activate the solenoid and set the activated condition from the remote control. The solenoid control then allows power from power supply 124 to flow to solenoid 114 and retract solenoid arm 116. When the signal stops, solenoid control 122 shuts off power to the solenoid, which then extends solenoid arm 116, by way of gravity, spring or other well known means, to interlock first locking part 100 with second locking part 102.

As shown in FIG. 9, a particularly advantageous embodiment of tamper-resistant master lock control 112 is provided. In FIG. 9, the tamper-resistant master lock control is incorporated into handle 41 of operator 40. The tamper-resistant master lock control includes a keypad 126 operatively associated with solenoid control 122 for controlling activation of solenoid 114 (FIG. 7). As described above, master lock assembly 98 includes a solenoid with a solenoid arm 116 that is extended and retracted by the solenoid to move first locking part 100 between locked and unlocked positions with second locking part 102, respectively. Solenoid control 122, incorporated into handle 41, includes a microprocessor in electronic communication with electronic keypad 126. The microprocessor receives an activation code from electronic keypad 126 to provide the activated condition for the tamper-resistant master lock control. Thus, when the correct code is entered on electronic keypad 126, the microprocessor sends code and power from power supply 124, incorporated into handle 41, along pathway 125. A second solenoid control 123 is proved within the compartment interior for receiving the code and power. If the corrected code is received by second solenoid control 123, power is then sent to solenoid 114 to retract first locking part 100. In order to transfer power and code from operator 40 to second solenoid control 123 and solenoid 114, shaft 43 includes a first contact 91 for providing electronic communication with a second contact 93 carried within the compartment interior by latch assembly 14. When shaft 43 is inserted into pinion 44, first contact 91 is aligned with second contact 93 to provide a transfer point for both power and code from solenoid control 122 to second solenoid control 123. If the entered code corresponds to an unlock command retained by second solenoid control 123, power from power supply 124 is sent to solenoid 114 to retract first locking part 100 to allow operator 40 to rotate pinion 44 and disengage latch assembly 14.

Figure 6:
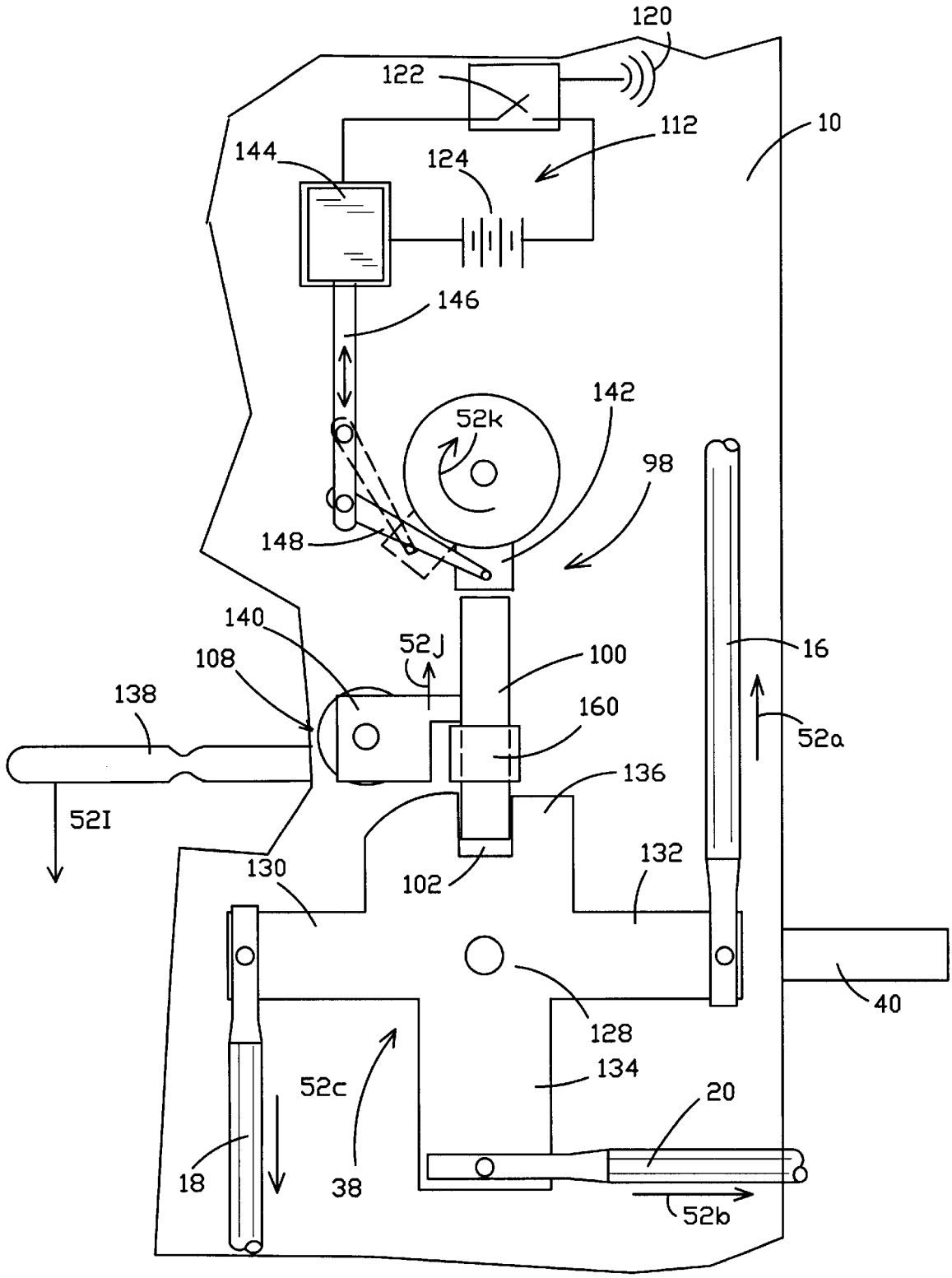
FIG. 6 shows an alternative embodiment of the security system.

Referring now to FIG. 6, an alternative embodiment for the security system is shown. Latch actuator, designated generally as 38, includes a rotary hub 128 carried by the interior side of door 10. Operator 40 is connectable to the rotary hub from outside the storage compartment and is rotatable to rotate the hub inside the compartment. Rotary hub 128 includes a plurality of latch arms 130, 132 and 134 connecting to the latch elements. Latch elements 16, 18 and 20 are pivotally connected to the latch arms so that when the hub is rotated to move the latch assembly to the engaged position, latch element 16 extends in direction 52*a*, latch element 18 extends in direction 52*c* and latch element 20 extends in direction 52*b* to latch with the storage compartment or engaged secondary latch assembly as described previously above. An additional latch arm 136 includes second locking part 102 for interlocking with first locking part 100 to prevent rotary hub 128 from rotating. Master lock actuator, designated generally as 108, includes a handle 138 operable from outside the storage compartment through door 10 for moving first locking part 100. Handle 138 is connected to lifting bar 140 so that when handle 138 is moved in direction 52*i*, lifting bar 140 is moved in direction 52*j* along with first locking part 100. However, master lock assembly, designated generally as 98, includes a stop 142 which must be moved before master lock actuator 108 may be operated. Stop 142 is pivotally attached to the interior side of door 10 above first locking part 100 to prevent movement of the first locking part to the unlocked position. Master lock assembly 98 further includes a solenoid 144 operatively associated with stop 142. The solenoid includes a solenoid arm 146 and a connector linkage 148 connecting the solenoid arm to stop 142. Solenoid arm 146 is retracted by solenoid 144, as described above, to move stop 142 in direction 52*k* to allow movement of first locking part 100 in direction 52*j*. A tamper-resistant master lock control, designated generally as 112, is operatively associated with solenoid 144 and includes an activated condition wherein solenoid arm 146 is retracted. In the preferred embodiment of the security system shown in FIG. 6, tamper-resistant master lock control 112 includes an electronic remote control operable from outside the storage compartment and sets the activated condition for activating solenoid 144 as described in detail above. In a further advantageous embodiment of the security system shown in FIG. 6, tamper-resistant master lock control 112 includes a combination lock operated from outside the storage compartment which is directly connected to stop 142. Entering the correct combination sets the activated condition which allows the combination lock to rotate and move stop 142 in direction 52*k* to allow movement of first locking part 100. The combination lock can also be unlocked through use of a key or other well known means for operating locks.

Referring now to FIG. 8, an alternative embodiment for the security system is shown. In this embodiment, master lock actuator 98 and operator 40 have been combined to provide a single handle for moving first locking part 100 and rotating latch actuator 128. As shown in FIG. 8, a latch actuator is provided in the form of a rotary hub 128 pivotally connected to the interior of door 10 with latch arms 130, 132 and 134 connected to latch elements 16, 18 and 20. Handle 150 on the outside of the storage compartment is connected through door 10 to bar 152 for rotating rotary hub 128 and lifting first locking part 100. Latch arm 136 includes an extended portion 154 with a rounded outer edge 156. The extended portion of latch arm 136 is connected to bar 152 by linkage 158, which is pivotally attached to both bar 152 and extend portion 154 of latch arm 136. Extended portion 154 further includes second locking part 102 for receiving first locking part 100 as described in detail above. When handle 150 is moved in direction 521, bar 152 is moved in direction 52*m* which first raises first locking part 100 in direction 52*m* before rotating hub 128. Bracket 160 is provided which helps maintain first locking part in proper vertical alignment with second locking part 102. As rotary hub 128 is moved in direction 52*n*, rounded outer portion 156 of extended portion 154 of latch arm 136 allows first locking part 100 to ride along the edge as the hub is rotated. When the hub is moved back to the engaged position opposite direction 52*n*, first locking part 100 will drop into second locking part 102 and prevent the hub from rotating. As was described in detail above, a stop 142 is provided for preventing first locking part 100 from being moved. The stop is connected to a solenoid 114 operated associated with a tamper-resistant master lock control of the type disclosed above.

While a preferred embodiment of the invention has been described using specific terms, such description is for illustrative purposes only, and it is to be understood that changes and variations may be made without departing from the spirit or scope of the following claims.

What is claimed is:

1. A security system of a storage compartment for securing first and second entryway doors of the storage compartment to prevent access to a compartment interior comprising:

a latch assembly including a primary and a secondary latch assembly;

said primary latch assembly carried by said first door for latching said first door in a closed position with said storage compartment;

said primary latch assembly being disposed entirely on an interior side of said first door within said compartment interior said secondary latch assembly being carded by said second door for latching said second door in a closed position with said storage compartment;

said secondary latch assembly being disposed entirely on an interior side of said second door within said compartment interior;

a plurality of reciprocating latch elements included in said latch assemblies for latching said first and second doors with top and bottom portions of said storage compartment;

a horizontal reciprocating latch element included in said primary latch assembly for controlling said secondary latch assembly between latching and unlatching said second door;

a primary latch actuator included in said primary latch assembly said primary latch actuator being connected to certain of said latch elements for moving said certain latch elements to latch said first door with said storage comportment said primary latch actuator further acting to actuate said secondary latch assembly;

a secondary latch actuator included in said secondary latch assembly, said secondary latch actuator being controlled by said horizontal reciprocating latch element to position selected ones of said secondary reciprocating latch elements to latch said second door with said storage compartment and said primary latch actuator comprises a rack pinion mechanism carried by said first door and having a pinion meshing with a plurality of toothed racks; said operator engaging and rotating said pinion drives said racks; said racks being connected to said main latch elements so that when said pinion is rotated by said operator said main latch elements latch said first door to said storage compartment and actuate said secondary latch assembly; and a removable manually operable operator for operating said primary latch actuator on said interior side of said door;

whereby access to said compartment interior is prevented when said primary latch assembly and said secondary latch assembly are operated to latch said first and second doors ether and with said storage compartment.

2. The security system of claim 1 including reinforcing mounting plates affixed to said interior side of said first and second doors respectively, said primary latch actuator and said secondary latch actuator being carried by said mounting plates within said compartment.

3. The security system of claim 1 wherein said primary latch actuator includes a rotary hub carded by said interior side of said first door; said operator being connectable to said rotary hub from outside said compartment and operable to rotate said hub; and said primary latch elements being connected to said hub so that when said hub is rotated said primary latch elements are moved vertically and said horizontal latch element induces vertical movement of said secondary assembly.

4. The security system claim 1 including a securing bracket carded by said second door; said securing bracket receiving said horizontal reciprocating latch element to secure said second door in a closed position with said first door.

5. A security system of a storage compartment for securing first and second entryway doors of the storage compartment to prevent access to a compartment interior comprising:

a latch assembly including a primary and a secondary latch assembly;

said primary latch assembly carried by said first door for latching said first door in a closed position with said storage compartment;

said primary latch assembly being disposed entirely on an interior side of said first door within said compartment interior;

said secondary latch assembly being carried by said second door for latching said second door in a closed position with said storage compartment;

said secondary latch assembly being disposed entirely on an interior side of said second door within said compartment interior;

a plurality of reciprocating latch elements included in said latch assemblies for latching said first and second doors with top and bottom portions of said storage compartment;

a horizontal reciprocating latch element included in said primary latch assembly for controlling said secondary latch assembly between latching and unlatching said second door;

a primary latch actuator included in said primary latch assembly said primary latch actuator being connected to certain of said latch elements for moving said certain latch elements to latch said first door with said storage compartment, said primary latch actuator further acting to actuate said secondary latch assembly;

a secondary latch actuator included in said secondary latch assembly, said secondary latch actuator being controlled by said horizontal reciprocating latch element to position selected ones of said secondary reciprocating latch elements to latch said second door with said storage compartment; and said secondary latch actuator includes an abutment bar pivotally connected to an upper pivot arm and a lower pivot arm; said upper and lower pivot arms each pivotally connected to one of said reciprocating latch elements so that when said abutment bar is operated, said pivot sins extend said reciprocating latch elements to latch said second door;

a removable manually operable operator for operating said primary latch actuator on said interior side of said door;

whereby access to said compartment interior is prevented when said primary latch assembly and said secondary latch assembly are operated to latch said first and second doors together and with said storage compartment.

6. The security system of claim 5 including a guide member carried by said abutment bar; said guide member being received by a guide bracket carried on said interior side of said second door to maintain said abutment bar in fixed vertical alignment with said horizontal latch element.

* * * * *